US006536400B1

(12) United States Patent
Inumaru et al.

(10) Patent No.: US 6,536,400 B1
(45) Date of Patent: Mar. 25, 2003

(54) LUBRICATING STRUCTURE FOR INTERNAL COMBUSTION ENGINE

(75) Inventors: Nobuaki Inumaru, Saitama (JP); Yasuo Shimura, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 118 days.

(21) Appl. No.: 09/707,951

(22) Filed: Nov. 8, 2000

(30) Foreign Application Priority Data

Nov. 12, 1999 (JP) ..... 11-323400

(51) Int. Cl.[7] ..... F01M 1/16
(52) U.S. Cl. ..... 123/196 R; 137/115.08
(58) Field of Search ..... 123/196 R, 196 CP, 123/196 S; 137/115.08, 115.26

(56) References Cited

U.S. PATENT DOCUMENTS 3,920,035 A * 11/1975 Werner ..... 137/115.08
4,546,786 A * 10/1985 Koike ..... 137/115.08
4,791,950 A * 12/1988 Pedersen ..... 137/115.26
5,311,905 A * 5/1994 De Santis ..... 137/115.08
5,339,776 A * 8/1994 Regueiro ..... 123/196 CP
5,666,915 A * 9/1997 Kawashima et al. .... 123/196 R
5,806,472 A * 9/1998 Nelson et al. ..... 123/196 S
5,857,442 A * 1/1999 Sumi ..... 123/196 CP
5,908,367 A * 6/1999 Tominaga et al. ..... 137/115.08
5,918,573 A * 7/1999 Killion ..... 123/196 R
5,947,230 A * 9/1999 Ohta ..... 123/196 CP
5,950,763 A * 9/1999 Ohta ..... 123/196 R
6,263,969 B1 * 7/2001 Stoesz et al. ..... 137/115.08

FOREIGN PATENT DOCUMENTS

JP A-9-144517 6/1997

* cited by examiner

*Primary Examiner*—Gene Mancene
*Assistant Examiner*—Jason Benton
(74) *Attorney, Agent, or Firm*—Birch, Stewart, Kolasch & Birch, LLP

(57) ABSTRACT

A relief valve is interposed in an oil supply passage, and the relief valve internally includes a bottom passage for supplying oil from one oil supply passage to another oil supply passage. Since any branched oil passage for a relief valve is not required to be provided, it is possible to reduce the machining steps and machining cost. Further, since a space for disposing a branched oil passage is not required and the increase in space for disposing the relief valve can be reduced, the engine can be miniaturized.

6 Claims, 7 Drawing Sheets

LUBRICATING STRUCTURE FOR INTERNAL COMBUSTION ENGINE

BACKGROUND OF THE INVENTION

1. Field of the Invention

The present invention relates to a lubricating structure for an internal combustion engine, which is suitable for suppressing the machining cost, miniaturizing the engine, and changing the amount of oil to be supplied to portions to be lubricated.

2. Description of Background Art

A relief valve opened when the pressure in an oil passage in an internal combustion engine exceeds a specific value has been known, for example, from Japanese Patent Laid-open No. Hei 9-144517 entitled "Transmission Lubricating Structure for Four-cycle Engine".

The transmission lubricating structure described in the above document is configured, as shown in FIG. 3 of the Japanese Laid-open publication, such that an oil pump 34 is communicated to an oil filter 35 via an oil passage 39, and a relief valve 44 is provided in an oil passage branched from the oil passage 39.

In the above-described technique, since the branched oil passage connected to the relief valve 44 is provided separately from the oil passage 39 for supplying oil to portions to be lubricated of an engine 7 via the oil filter 35, the number of machining steps for forming the branched oil passage and the machining cost required therefor are increased. In addition, since a space is required for providing the branched oil passage and the relief valve 44, the size of the engine 7 is enlarged.

Further, the flow rate of oil supplied from the oil pump 34 to the oil filter 35 side via the oil passage 39 can be changed by the relief valve 44. However, if it is intended to change the amount of oil to be supplied to portions to be lubricated on the downstream side from the relief valve 44, the configuration of the lubricating structure must be changed on a large-scale. For example, the existing oil pump 34 must be replaced with a new oil pump having a different displacement, or the existing oil passage 39 must be replaced with a new oil passage having a different crosssection.

SUMMARY AND OBJECTS OF THE INVENTION

An object of the present invention is to provide a lubricating structure for an internal combustion engine, which is capable of (1) suppressing the machining cost and miniaturizing the engine, and (2) easily changing the amount of oil to be supplied to portions to be lubricated.

To achieve the above object, according to the present invention, there is provided a lubricating structure for an internal combustion engine including an oil supply passage for supplying oil from an oil pump to portions to be lubricated and a relief valve which is opened for relieving part of the oil into a relief passage when the pressure in the oil supply passage exceeds a specific valve, characterized in that the relief valve is interposed in the oil supply passage, and the relief valve internally includes a passage for supplying oil from one oil supply passage to another oil supply passage.

The relief valve, which is interposed in the oil supply passage, allows the supply of oil from one oil supply passage to another oil passage through the passage provided in the relief valve. Such a relief valve is opened for relieving part of the oil in the relief passage when the pressure in the oil supply passage exceeds a specific value.

As a result, it is possible to eliminate the need for providing a branched oil passage for the relief valve and hence to reduce the number of machining steps and lower the machining cost.

Further, since a space for disposing a branched oil passage is not required and since an increase in the space for disposing of the relief valve can be reduced, the engine can be miniaturized.

According to the present invention, a throttle structure for restricting the flow rate of the oil to be supplied to the portions to be lubricated by the relief valve is provided in the oil supply passage.

The relief valve opened when the pressure in the oil supply passage exceeds a specific value is provided in the oil supply passage, and the throttle structure for restricting the flow rate of the oil to be supplied to the portions to be lubricated is provided in the relief valve.

As a result, the amount of oil to be supplied to the portions to be lubricated can be easily changed only by changing the throttle structure.

According to the present invention, the throttle structure is configured as an orifice hole opened in a valve body of the relief valve.

The throttle structure is configured as the orifice hole opened in the relief valve.

As a result, since the valve body of the relief valve serves as the throttle structure, the lubricating structure can be simplified and the number of parts can be reduced, as compared with the case in which the valve body and a member in which the orifice hole is opened are provided separately from each other.

Further, the amount of oil to be supplied to the portions to be lubricated can be easily changed by replacing an existing valve body with a new valve body having an orifice whose cross-section is suitably changed from that of the orifice of the existing valve body.

According to the present invention, the relief valve is provided in an oil supply passage passing through a portion near a power transmission member in the internal combustion engine. As a result, the power transmission member can be lubricated with the oil which has flowed out of the relief passage of the relief valve.

This makes it possible to eliminate the need of providing any special oil passage for supplying oil to the power transmission member.

According to the present invention, the power transmission member is a cam chain hung between a crank shaft and a cam shaft in the internal combustion engine, and the relief valve is provided in such a manner so as to cross a cam chain chamber for containing the cam chain.

The power transmission member is configured as the cam chain hung between the crank shaft and the cam shaft in the internal combustion engine, and the relief valve is provided in such a manner so as to cross a cam chain chamber for containing the cam chain.

As a result, the cam chain can be lubricated with the oil which has flowed out of the relief passage of the relief valve. Further, since the oil adhering on the cam chain can be scattered to a cylinder head, it is possible to lubricate respective portions of the cylinder head with the scattered oil.

Further, since the relief valve serves as a pipe member crossing the cam chain chamber, it is possible to reduce the number of parts as compared with the case in which the relief valve and the pipe member are provided separately from each other, and hence to reduce the manufacturing cost of the engine.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
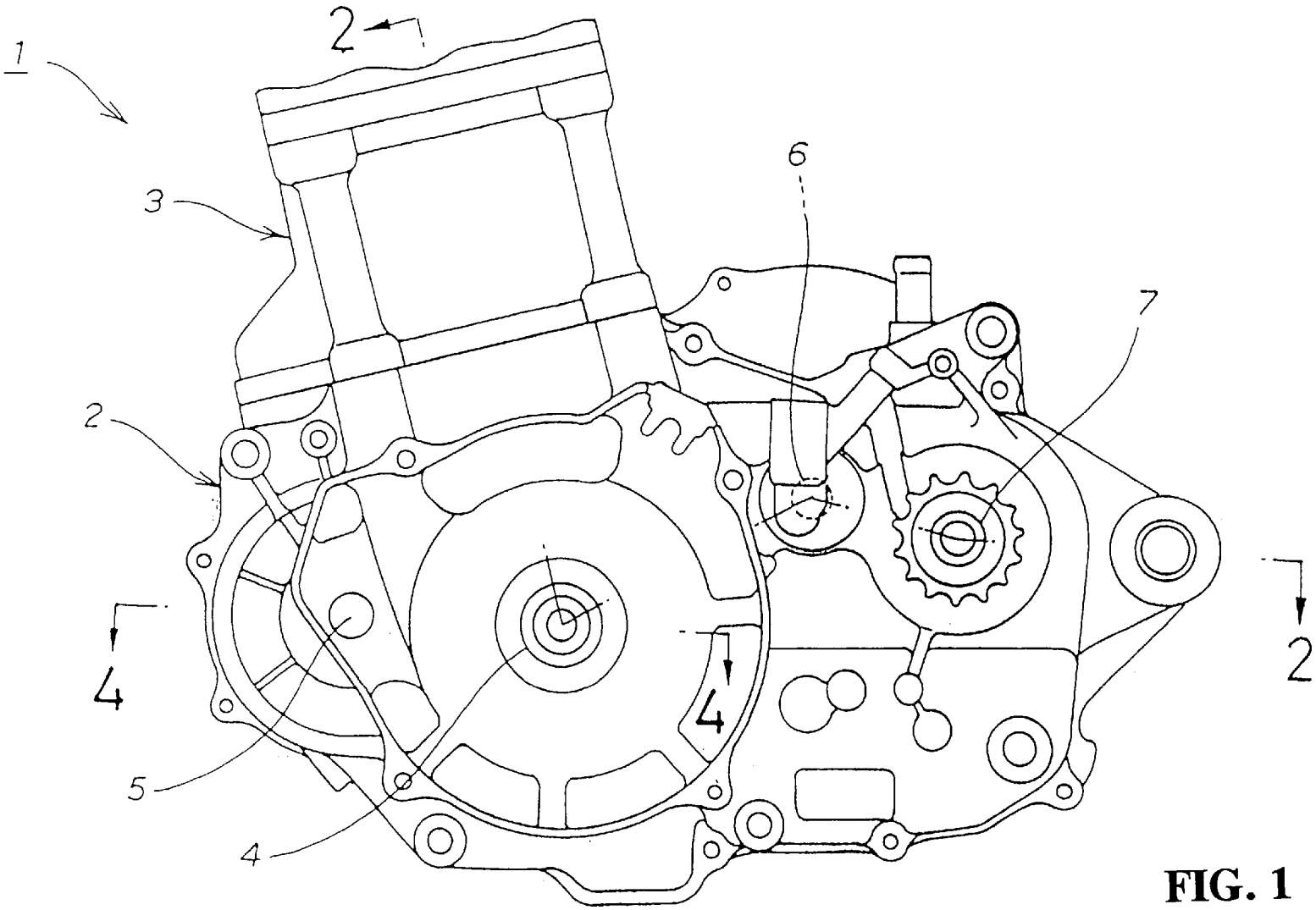
FIG. 1 is a side view of an internal combustion engine to which a lubricating structure of the present invention is applied.

Hereinafter, embodiments will be described with reference to the accompanying drawings. FIG. 1 is a side view of an internal combustion engine to which a lubricating structure of the present invention is applied. In FIG. 1, an AC generator is mounted on an end portion of a crank shaft. A cover for covering the AC generator, and a cover for covering a side portion of a transmission are omitted for an easier understanding of the present invention.

An internal combustion engine I includes a crank case portion 2 and a cylinder block 3. The crank case portion 2 contains rotatable shafts: a crank shaft 4, a balancer shaft 5 located in front of the crank shaft 4, and a main shaft 6 and a counter shaft 7 located on the transmission side behind the crank shaft 4.

Figure 2:
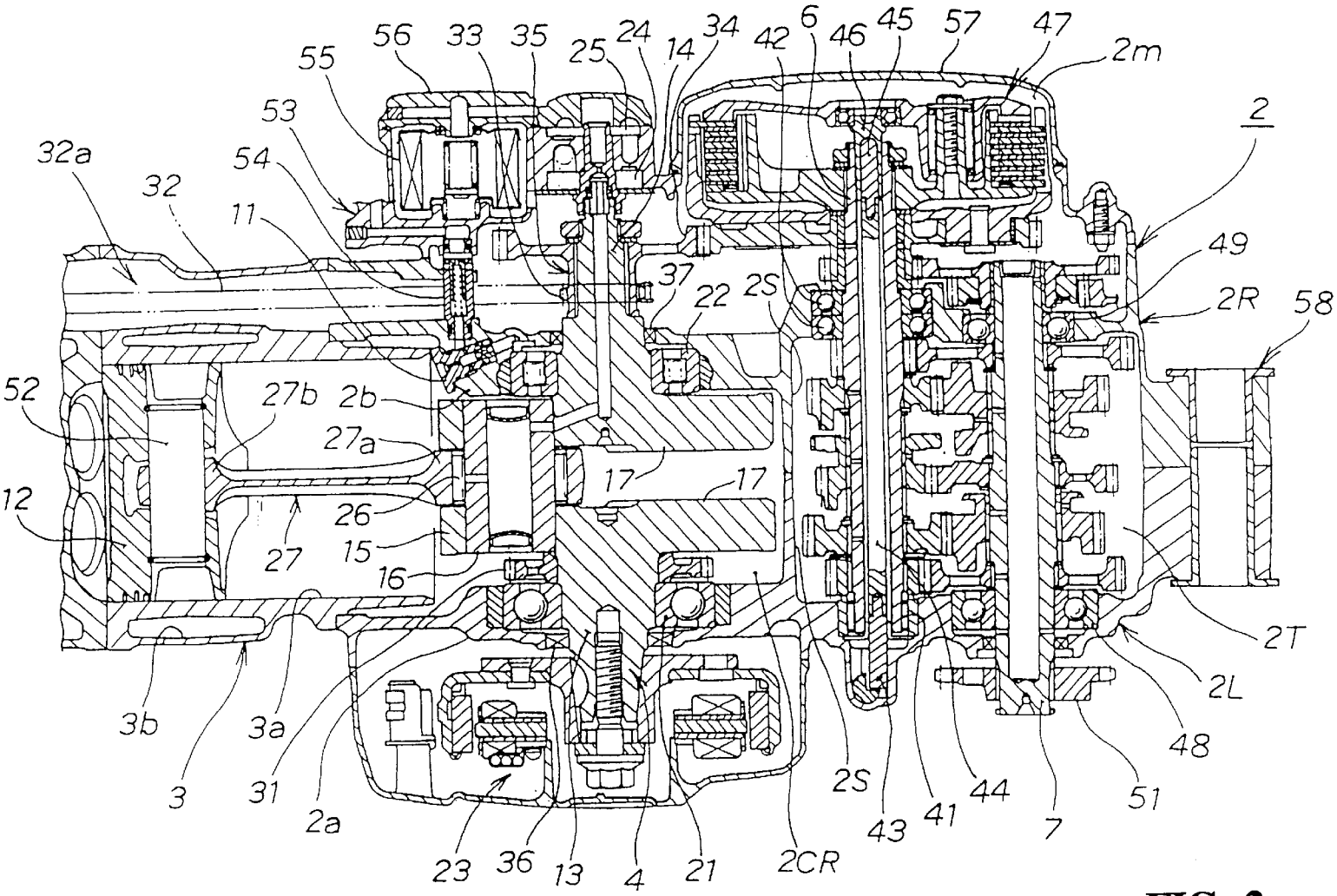
FIG. 2 is a sectional view taken on line 2—2 of FIG. 1.

FIG. 2 is a sectional view taken on line 2—2 of FIG. 1. The crank case portion 2 is formed by fitting crank cases 2L and 2R to each other. The inside of the crank case portion 2 is divided into an enclosed crank chamber 2CR and an enclosed transmission chamber 2T. These crank chamber 2CR and transmission chamber 2T are separated from each other by means of partition walls 2S.

The crank case 2L includes a first main bearing portion 2*a* for mounting one end portion of the crank shaft 4 to the crank case 2L, and the crank case 2R includes a second main bearing portion 2*b* for mounting the other end portion of the crank shaft 4 to the crank case 2R. An oil jet nozzle 11 (which will be described later) for cooling a piston is mounted in a portion, on the cylinder block 3 side, of the second main bearing portion 2*b*.

The cylinder block 3 is a water-cooled type block in which cooling water flows in a water jacket 3*b*. A piston 12 is movably inserted in a cylinder portion 3*a* of the cylinder block 3.

The crank shaft 4 includes first and second shaft portions 13 and 14; a crank portion 15 for connecting the first and second shaft portions 13 and 14 to each other; a crank pin 16 mounted on the crank portion 15; and two counter weights 17 provided on portions, opposite to the crank portion 15 with respect to the axis of the first and second shaft portions 13 and 14, of the first and second shaft portions 13 and 14.

One end portion of the crank shaft 4 is rotatably mounted on the crank case 2L via a radial ball bearing 21, and an AC generator 23 for power generation is mounted at the leading end of the one end portion of the crank shaft 4. The other end portion of the crank shaft 4 is rotatably mounted on the crank case 2R via a radial roller bearing 22, and first and second oil pumps 24 and 25 for dry sump lubrication are mounted at the leading end of the other end portion of the crank shaft 4. A large end portion 27*a* of a connecting rod 27 is rotatably mounted on the crank pin 16 via a bearing 26. A balancer shaft drive gear 31 for driving the balancer shaft 5 (see FIG. 1) is fitted to the first shaft portion 13. A gear member 35 is mounted to the second shaft portion 14. The gear member 35 includes a cam shaft drive gear 33 for driving a cam shaft (not shown) via a cam chain 32 as a power transmission member and a main shaft drive gear 34 for driving the main shaft 6 on the transmission side. In FIG. 2, oil seals 36 and 37 are provided for preventing leakage of oil from the crank chamber 2CR.

One end portion of the main shaft 6 is rotatably mounted on the crank case 2L via a bearing 41 and the other end portion of the main shaft 6 is rotatably mounted on the crank case 2R via two bearings 42. The main shaft 6 contains a first rod 43, a second rod 44, a third rod 45, and a fourth rod 46, each of which is axially movably mounted. A clutch 47 is axially movably spline-connected to the outer periphery of the other end portion, on the crank case 2R side, of the main shaft 6, and a plurality of drive gears are axially movably spline-connected to the outer periphery of the clutch 47.

The engagement/disengagement of the clutch 47 is performed by axial movement of the first, second, third and fourth rods 43, 44, 45 and 46, to thereby control the transmission of a drive force from the crank shaft 4 to the main shaft 6.

One end portion of the counter shaft 7 is rotatably mounted to the crank case 2L via a bearing 48, and the other end portion of the counter shaft 7 is rotatably mounted on the crank case 2R via a bearing 49. A plurality of driven gears to be meshed with the drive gears of the main shaft 6 are axially movably spline-connected to the outer periphery of the other end portion, on the crank case 2R side, of the counter shaft 7. A drive sprocket 51 for driving a wheel (not shown) via a chain (not shown) is mounted on the leading end of the one end portion, on the crank case 2L side, of the counter shaft 7.

The piston 12 is rotatably mounted to a small end portion 27*b* of the connecting rod 27 via a piston pin 52.

In FIG. 2, a case side cover 53 is provided for covering a side portion of the crank case 2R. A relief valve 54 extends between the case side cover 53 and the second main bearing portion 2*b* of the crank case 2R. An oil filter 55 is provided together with an oil filter cover 56 and a cover 57 for covering the outer side of the clutch 47. A mounting portion 58 is provided by means of which the engine 1 (see FIG. 1) is mounted to a body frame (not shown).

The relief valve 54 is mounted in such a manner so as to cross a cam chain chamber 32*a* for allowing the cam chain 32 to pass therethrough. The cam chain chamber 32*a* is formed in the cylinder block 3 and a cylinder head. The relief valve 54 serves as a pipe member for connecting an oil supply passage on the case side cover 53 side to an oil supply passage on the second main bearing portion 2*b* side of the crank case 2R.

Accordingly, as compared with the case in which the relief valve 54 and the pipe member are separately provided, the number of parts can be reduced and thereby the manufacturing cost of the engine can be lowered.

Figure 3A:
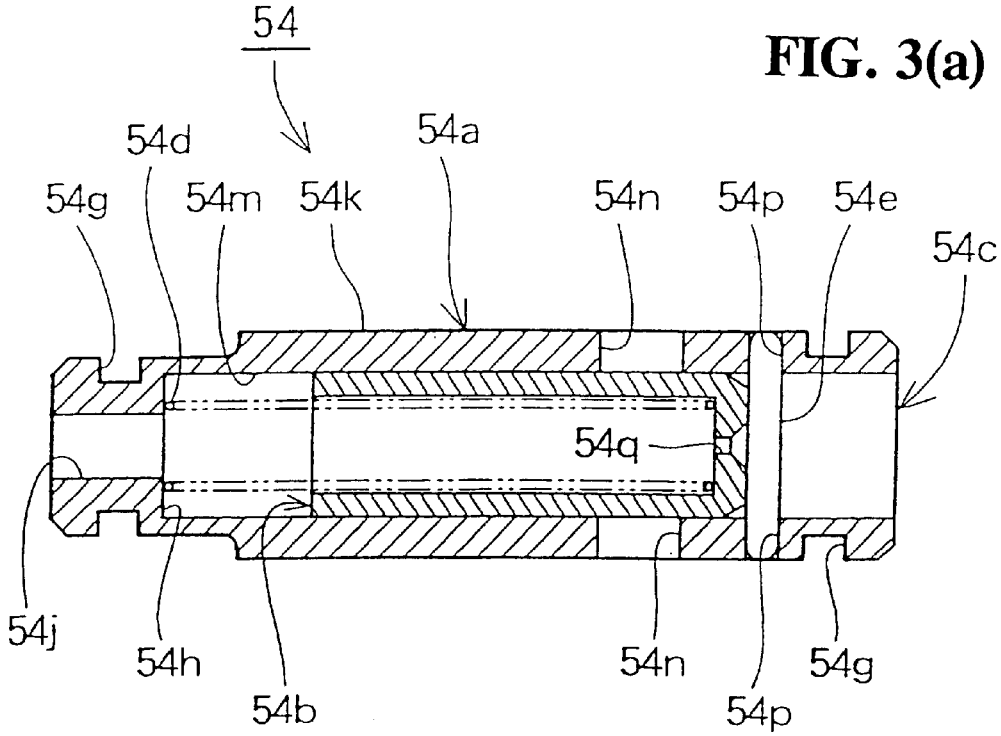
FIGS. 3(*a*) and 3(*b*) are sectional views of a relief valve constituting the lubricating structure of the present invention.
Figure 3B:
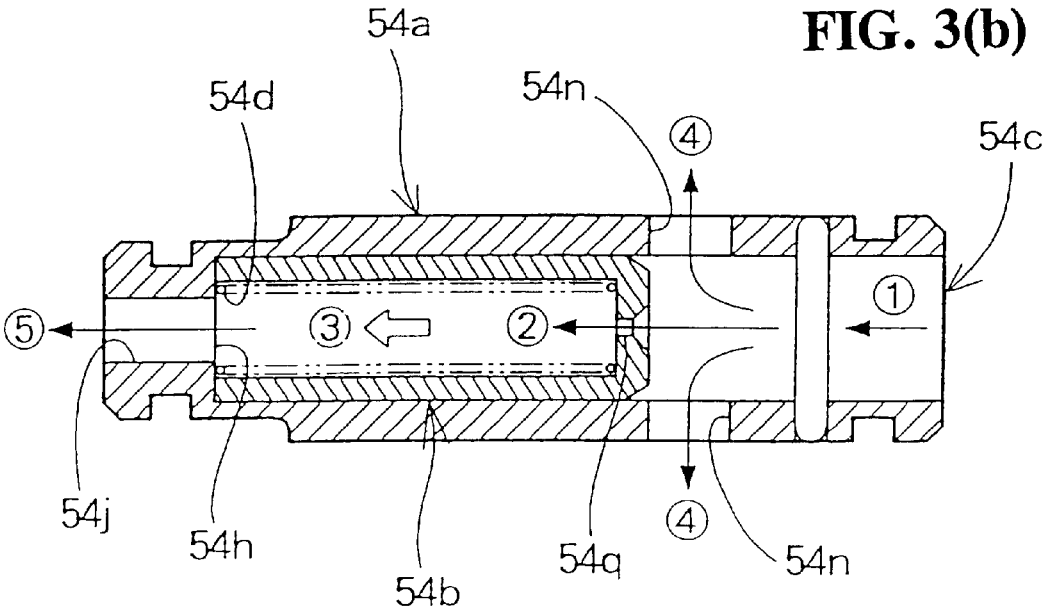

FIGS. 3(*a*) and 3(*b*) are sectional views showing a relief valve constituting a lubricating structure of the present invention, wherein FIG. 3(*a*) illustrates components of the relief valve and FIG. 3(*b*) illustrates the function of the relief valve.

Referring to FIG. 3(*a*), the relief valve 54 includes a valve case 54*a* formed into a cylindrical shape with its bottom closed; a valve body 54*b* formed into a cylindrical shape with its bottom closed, which valve body is movably inserted in the valve case 54*a;* a coil spring 54*d* for elastically biasing the valve body 54*b* to an opening 54*c* side of the valve case 54*a;* and a pin 54*e* which passes through the valve case 54*a* for preventing the valve body 54*b* from being accidentally removed from the opening 54*c*.

Two O-ring grooves 54*g,* in which O-rings are to be fitted, are formed in the outer peripheral surface 54*k* of the valve case 54*a*. A bottom passage 54*j* which is the passage for supplying oil from one oil passage to another oil passage is opened in a bottom 54*h* of the valve case 54*a*. Two relief passages 54*n* and two pin insertion holes 54*p* are opened in the outer peripheral surface 54*k* of the valve case 54*a* in such a manner as to reach an inner peripheral surface 54*m* of the valve case 54*a*.

The valve body 54*b* has an orifice hole 54*q* functioning as a throttle structure for communicating, in the valve case 54*a,* an oil chamber on the opening 54*c* side to an oil chamber on the bottom 54*h* side.

Referring to FIG. 3(*b*), when oil is supplied from the opening 54*c* side into the valve case 54*a* in the direction shown by an arrow (1), it flows in the oil chamber on the bottom 54*h* side of the valve case 54*a* through the orifice hole 54*q* of the valve body 54*b* as shown by an arrow (2). At this time, the valve body 54*b* is moved leftward in FIG. 3(*b*) against the elastic force of the coil spring 54*d* as shown by an arrow (3).

When the valve body 54*b* is moved by a specific distance, the relief passages 54*n* having been closed by the valve body 54*b* are opened, so that the oil flows out of the valve case 54*a* as shown by arrows (4).

The oil having flowed on the bottom 54*h* side of the valve body 54*a* flows out of the valve case 54*a* through the bottom passage 54*j* of the valve case 54*a* as shown by an arrow (5).

As described above, the present invention is characterized in that the throttle structure is configured as the orifice hole 54*q* opened in the valve body 54*b* of the relied valve 54.

Since the valve body 54*b* of the relief valve 54 serves as the throttle valve, the lubricating structure can be simplified and also the number of parts can be reduced as compared with the case in which a member having an orifice hole is provided separately from the valve body.

Further, the amount of oil to be supplied to portions to be lubricated can be easily changed by replacing an existing valve body 54*b* with a new valve body 54*b* having an orifice whose cross-section is suitably changed from that of the orifice of the existing valve body 54*b*.

Figure 4:
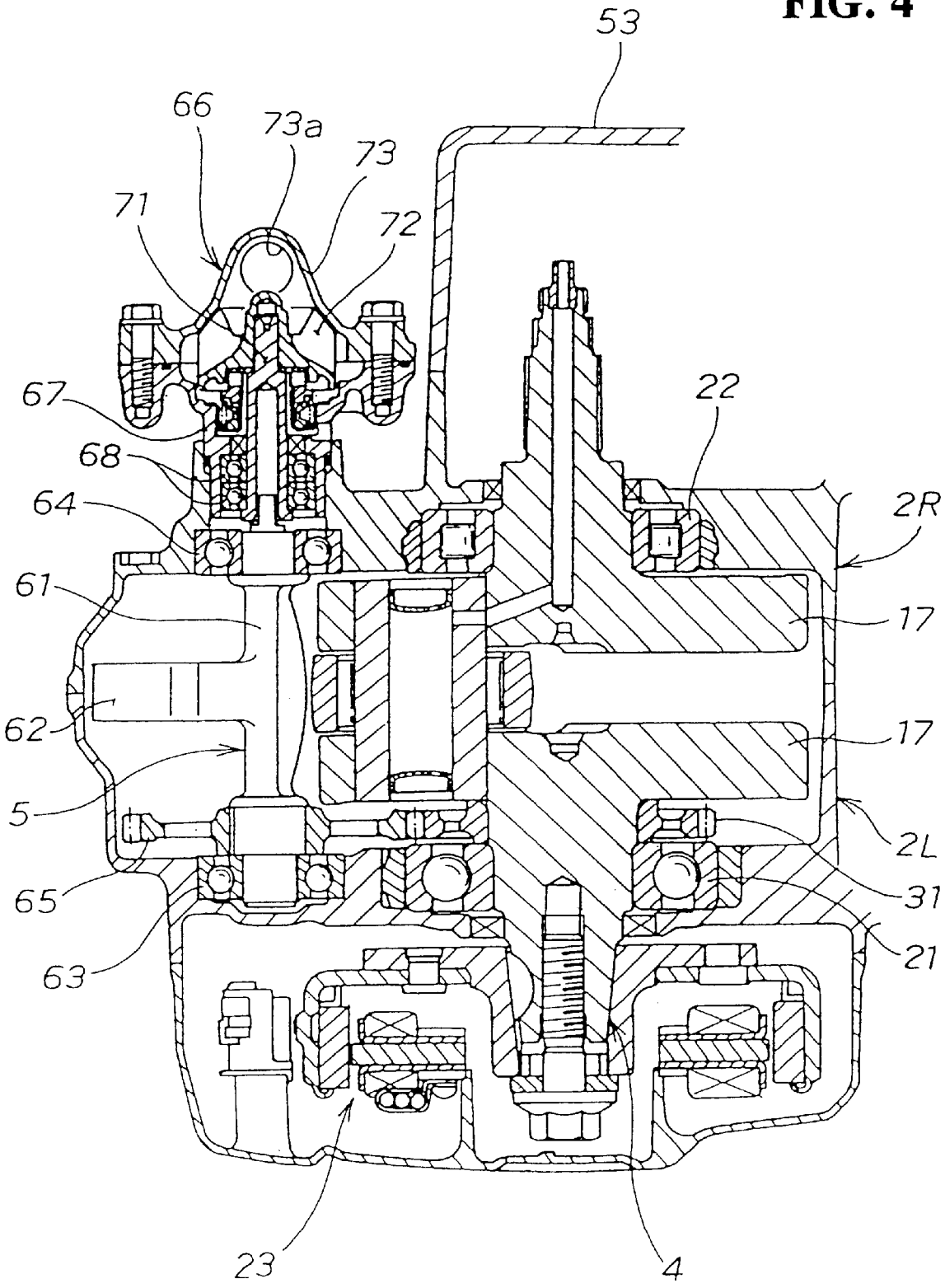
FIG. 4 is a sectional view taken on line 4—4 of FIG. 1.

FIG. 4 is a sectional view taken on line 4—4 of FIG. 1. The balancer shaft 5 includes a shaft portion 61 and a weight 62 provided at a central portion of the shaft portion 61. The balancer shaft 5 rotates at a speed equal to that of the crank shaft 4 in the rotational direction reversed to that of the crank shaft 4 for suppressing vibration of the engine 1. One end portion of the balancer shaft 5 is rotatably mounted on the crank case 2L via a bearing 63, and the other end portion of the balancer shaft 5 is rotatably mounted on the crank case 2R via a bearing 64. A driven gear 65 to be meshed with the balancer shaft drive gear 31 fitted on the crank shaft 4 is fitted on the shaft portion 61, and a water pump 66 for circulating cooling water is connected to an end portion, on the bearing 64 side, of the balancer shaft 5.

The water pump 66 includes a base portion 67 mounted on a side surface of the crank case 2R. A rotational shaft 71 is provided that is rotatably mounted on the base portion 67 via two bearings 68 and connected to the balancer shaft 5. An impeller 72 is mounted on the rotational shaft 71. A case portion 73 is provided on the base portion 67 for containing the impeller 72. An inlet 73*a* is formed in the case 73.

Figure 5:
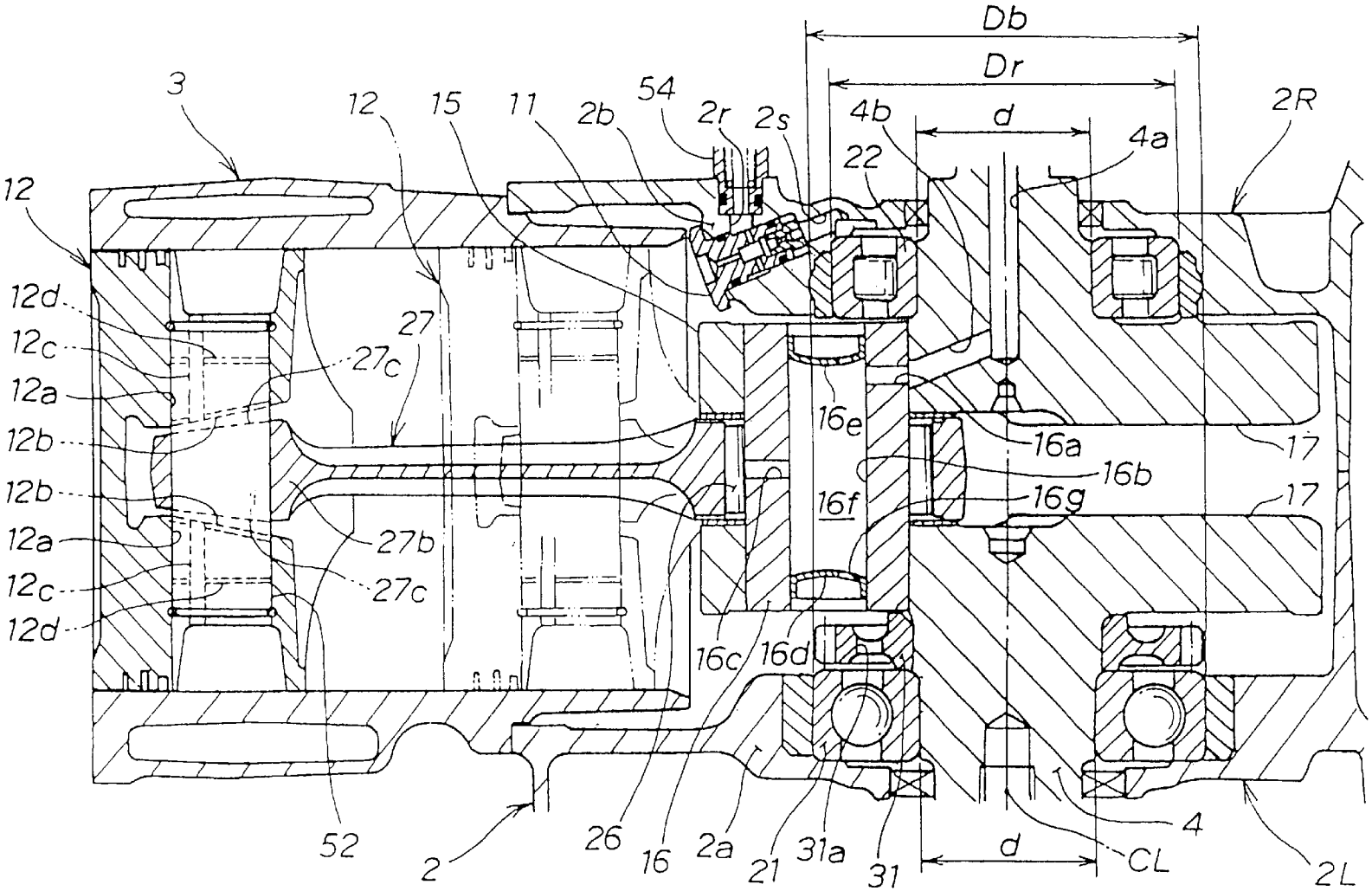
FIG. 5 is a sectional view showing an essential portion of the engine to which the present invention is applied.

FIG. 5 is a sectional view showing an essential portion of the lubricating structure for an engine according to the present invention. The second main bearing portion 2*b* of the crank case 2R has a main oil passage 2*r* for supplying oil to the oil jet nozzle 11 and a sub-oil passage 2*s* branched from the main oil passage 2*r* and extending to the radial roller bearing 22. The crank shaft 4 has a first oil passage 4*a* and a second oil passage 4*b* continuous to the first oil passage 4*a*. The crank pin 16 has a first transverse oil passage 16*a* in communication with the second oil passage 4*b* formed in the crank shaft 4, a hollow portion 16*b,* and a second transverse oil passage 16*c*. The leading end of the second transverse oil passage 16*c* faces to the bearing 26. Both plugs 16*d* and 16*e* are fitted to both ends of the hollow portion 16*b* to form an in-pin oil chamber 16*f* Each of the plugs 16*d* and 16*e* have an injection hole 16*g*. The balancer shaft drive gear 31 has a through-hole 31*a*. The injection hole 16*g* is opened at a position corresponding to the through-hole 31*a*.

As shown in FIG. 5, both end surfaces 27*c* of the small end portion 27*b* of the connecting rod 27 are each formed into a tapering shape. Both inner end surfaces 12*b* of pin holes 12*a* of the piston 12 are each formed into a shape nearly similar to that of each of the end surfaces 27*c* of the small end portion 27*b* with a gap put between the inner end surface 12*b* and the end surface 27*c*. The inner peripheral surfaces of the pin holes 12*a* includes a vertical groove 12*c* and a peripheral groove 12*d*. In FIG. 5, character CL designates the axis (rotational center) of the crank shaft 4. A bottom dead center of the piston 12 is shown by an imaginary line.

A mounting hole is opened from the cylinder block 3 side into the second main bearing portion 2*b* of the crank case 2R, and the oil jet nozzle 11 is inserted in the mounting hole. By mounting the cylinder block 3 to the crank case portion 2 after insertion of the oil jet nozzle 11, the loosening of the oil jet nozzle 11 from the mounting hole is prevented by the lower end of a skirt portion of the cylinder block 3.

The above-described mounting of the oil jet nozzle 11 is superior in both assembling performance and maintenance performance to the mounting of the oil jet nozzle 11 by press-fitting or screwing the oil jet nozzle 11 in the mounting hole.

The oil jet nozzle 11 includes an upper main body, and a lower lid member screwed in the main body. The lid member includes an orifice for adjusting the amount of oil to be supplied to the sub-oil passage 2*s* side, thereby adjusting an oil supply ratio between the amount of oil to be jetted and the amount of oil to be supplied to the sub-oil passage 2*s* side.

With this structure of the oil jet nozzle 11, the above-described oil supply ratio can be simply adjusted by replacing an existing lid member with a new lid member having an orifice whose cross-section is suitably changed from that of the orifice of the existing lid member.

It is assumed that the radial ball bearing 21 has an inside diameter "d" and an outside diameter "Db".

It is also assumed that the radial roller bearing 22 has the same inside diameter "d" as that of the radial ball bearing 21 and an outside diameter "Dr".

In a radial ball bearing, balls are in point-contact with inner and outer races, while in a radial roller bearing, rollers are in line-contact with inner and outer races. Accordingly, the safety load of a radial roller bearing can be generally set at a value being as large as several times the safety load of a radial ball bearing. In other words, if the safety load of a radial roller bearing is equal to that of a radial ball bearing, the dimensions of inner and outer races of the radial roller bearing become smaller than those of the radial ball bearing.

In this embodiment, the inside diameter of the radial ball bearing 21 is the same as that of the radial roller bearing 22, and the outside diameter Db of the radial ball bearing 21 is larger than the outside diameter Dr of the radial roller bearing 22 (Db>Dr).

That is to say, by using the radial roller bearing 22 as the bearing at the second main bearing portion 2*b,* the outside diameter of the bearing can be made smaller as compared with the case using, as the bearing at the second main bearing portion 2*b,* the radial ball bearing 21 having the same inside diameter as that of the radial roller bearing 22.

If a radial roller bearing is also used as the bearing at the first main bearing portion 2*a,* a bearing for restricting the positions, in the trust direction, of both the radial roller bearings at the first and second main bearing portions 2*a* and 2*b* must be additionally provided; however, in this embodiment, since the radial ball bearing 21 is used as the bearing at the first main bearing portion 2*a,* it is not required to add the above-described position restricting bearing. Accordingly, even when the oil jet nozzle 11 is mounted to the second main bearing portion 2*b,* the distance between the axis CL of the crank shaft 4 and the mounting position of the oil jet nozzle 11 can be made smaller.

As a result, it is possible to lower the bottom dead center of the piston 12 and hence to shorten the overall length of the connecting rod 27. This makes it possible to make small the overall height of the cylinder block 3 and hence to miniaturize the engine 1 (see FIG. 1).

Since the width (in the longitudinal direction of the crank shaft 4) of the radial roller bearing 22 is smaller than that of the radial ball bearing 21, it is possible to make smaller the overall width of the engine 1 as compared with the case using the radial ball bearings 21 as the bearings at the first and second main bearing portions 2*a* and 2*b*.

The function of the above-described lubricating structure for an engine will be described below.

Figure 6:
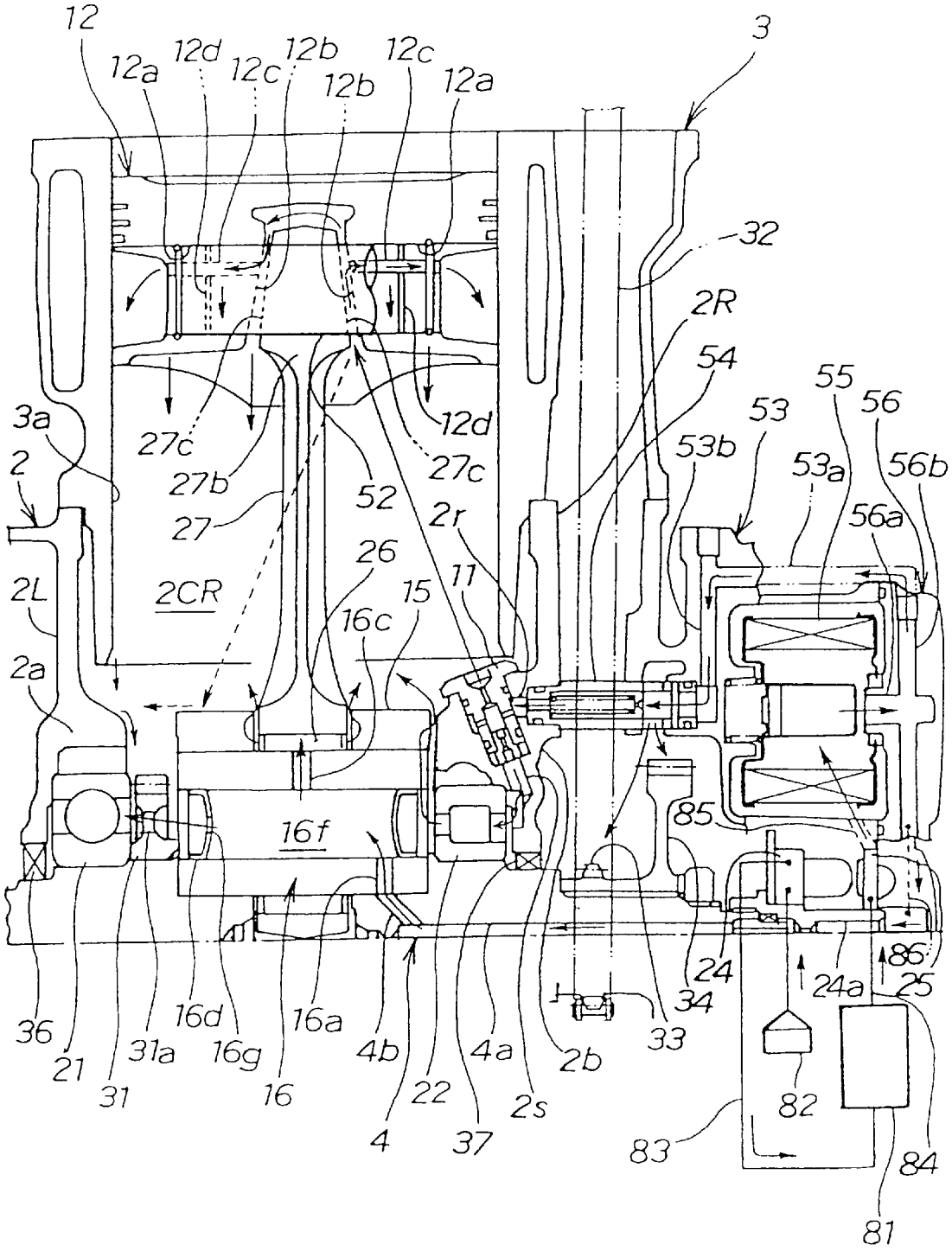
FIG. 6 is a view illustrating the function of the lubricating structure for an engine according to the present invention.

FIG. 6 is a view illustrating the function of the lubricating structure for an engine according to the present invention. Additionally, for an easy understanding, this figure is viewed in the direction in which the cylinder block 3 is raised upright.

In FIG. 6, an oil passage 24*a* is formed in the first and second oil pumps 24 and 25. Oil passages 53*a* and 53*b* are formed in the case side cover 53. Oil passages 56*a* and 56*b* are formed in an oil filter cover 56. An oil tank 81 is provided together with an oil strainer 82. An oil passage 83 is provided for providing communication between the first pump 24 and the oil tank 81. An oil passage 84 provides communication between the oil tank 81 and the second oil pump 25. An oil passage 85 provides communication between the second oil pump 25 and the oil filter 55. An oil passage 86 provides communication between the oil passage 56*b* of the oil filter cover 56 and the oil passage 24*a*.

The dry sump lubrication for an essential portion of the engine will be described below.

Oil accumulated in the oil tank 81 is pumped via the oil passage 84 by the second oil pump 25, fed from the second oil pump 25 to the oil filter 55 via the oil passage 85, and is fed from the oil filter 55 to the relief valve 54 via the oil passages 56*a,* 56*b,* 53*a* and 53*b*.

Part of the oil fed to the relief valve 54 passes through the orifice hole 54*q* as shown in FIG. 3(*b*), and as shown in FIG. 6, the oil is then fed from the inside of the relief valve 54 to the main oil passage 2*r* of the second main bearing portion 2*b,* and is supplied from the main oil passage 2*r* to the oil jet nozzle 11.

As shown in FIG. 3(*b*), the rest of the oil fed to the relief valve 54 flows in the relief passages 54*n,* to be scattered from the relief passages 54*n* into the crank chamber 2CR, thereby lubricating the meshing portion of the main shaft drive gear 34, and the meshing portion between the cam shaft drive gear 33 and the cam chain 32.

The oil supplied to the oil jet nozzle 11 is jetted from the leading end of the oil jet nozzle 11 into the inside of the piston 12.

At some position in the course where the piston 12 is lowered from the top dead center, the oil jetted from the oil jet nozzle 11 enters in the right gap between the end surface 27*c* of the small-end portion 27*b* of the connecting rod 27 and the inner end surface 12*b* of the piston 12, and partially flows in the vertical groove 12*c* and the peripheral groove 12*d* of the pin hole 12*a* located rightwardly from the small-end portion 27*b* in FIG. 6, to thereby lubricate the inner surface, on which the piston pin 52 is slid, of the pin hole 12*a*.

The oil, which has thus entered in the right gap between the end surface 27*c* of the connecting rod 27 and the inner end surface 12*b* of the piston 12, partially flows upwardly, passing through the upper side of the small-end portion 27*b* of the connecting rod 27, and reaches the left gap between the end surface 27*c* of the connecting rod 27 and the inner end surface 12*b* of the piston 12. The oil, which has thus reached the left gap, enters in the vertical groove 12*c* and the peripheral groove 12*d* of the pin hole 12*a* located leftwardly from the small-end portion 27*b* in the figure, to thereby lubricate the inner surface, on which the piston pin 52 is slid, of the pin hole 12*a*.

According to this embodiment, since the small-end portion 27*b* of the connecting rod 27 is formed into the tapering shape tilted nearly in parallel to the scattering direction of the oil jetted from the oil jet nozzle 11, it is possible to enhance the oiling performance to the small-end portion 27*b*.

The oil, which has thus lubricated the insides of the pin holes 12*a,* is dropped or flows along the cylinder portion 3*a,* to reach the first and second main bearing portions 2*a* and 2b and the crank portion 15. Part of the dropped oil may collide with the counter weights of the rotating crank shaft 4 into oil mist.

Part of the oil, which has been jetted from the oil nozzle 11 into the gap between the end surface 27*c* of the connecting rod 27 and the inner end surface 12*b* of the piston 12, is splashed by the lower portion of the piston 12 and the piston pin 52 and is scattered, as shown by a broken line, to the crank portion 15 and its neighborhood, to thereby lubricate the meshing portion between the balancer shaft drive gear 31 and the driven gear 65 (see FIG. 6) and the radial ball bearing 21.

The oil branched from the main oil passage 2*r* of the second main bearing portion 2*b* into the sub-oil passage 2*s* reaches the radial roller bearing 22, to lubricate the radial roller bearing 22.

The oil is then scattered from the radial roller bearing 22 into the crank chamber 2CR while passing through the gap between the second main bearing portion 2*b* and the crank portion 15.

The oil fed from the oil filter 55 into the oil passages 56*a* and 56*b* passes through the oil passages 86 and 24*a,* and through the first and second oil passages 4*a* and 4*b* in the crank shaft 4 and the first transverse oil passage 16*a,* in-pin oil chamber 16*f,* and second transverse oil passage 16*c* in the crank pin 16, and reaches the bearing 26 of the connecting rod 27, to lubricate the bearing 26. The oil, which has thus lubricated the bearing 26, is scattered in the crank chamber 2CR through the gap between the crank portion 15 and the connecting rod 27.

The oil in the in-pin oil chamber 16*f* of the crank pin 16 is further injected from the injection hole 16*g* of the plug 16*d,* passing through the through-hole 31*a* of the balancer shaft drive gear 31, and reaches the radial ball bearing 21, to lubricate the radial ball bearing 21.

The oil, which has thus lubricated respective portions in the crank chamber of the engine, is led through an oil outlet (not shown) provided in the bottom of the crank chamber to an oil strainer communicated to the inlet of an oil pump provided outside the crank chamber, and is pumped from the oil strainer 82 provided in an oil sump (not shown) of the crank case portion 2 into the oil tank 81 via the oil passage 83 by the first oil pump 24.

According to the present invention, since oil is supplied from the single oil pump to the crank shaft portion and the piston portion via the relief valve having the orifice, which relief valve is provided in the supply passage to the piston portion, it is possible to prevent the supply of an excess amount oil to the piston portion while ensuring the supply of the necessary amount of oil to the crank shaft portion, and hence to reduce the friction loss due to an increase in amount of oil accumulated in the crank chamber.

Figure 7A:
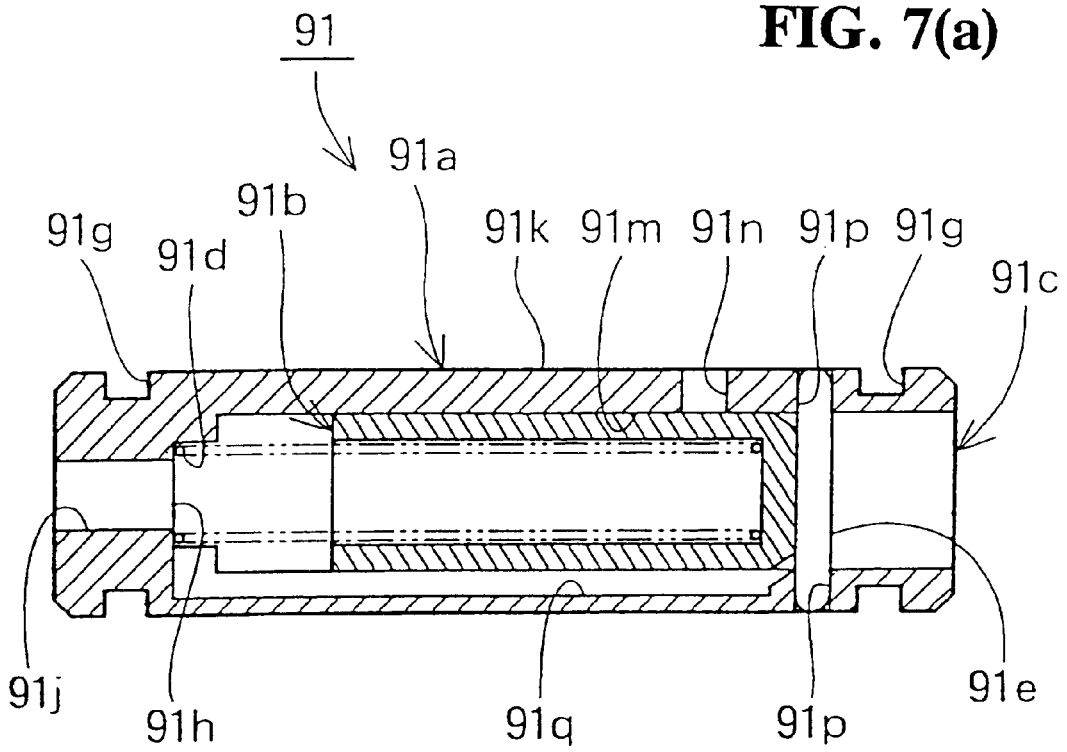
FIGS. 7(*a*) and 7(*b*) are sectional views showing another embodiment of the relief valve constituting the lubricating structure of the present invention.
Figure 7B:
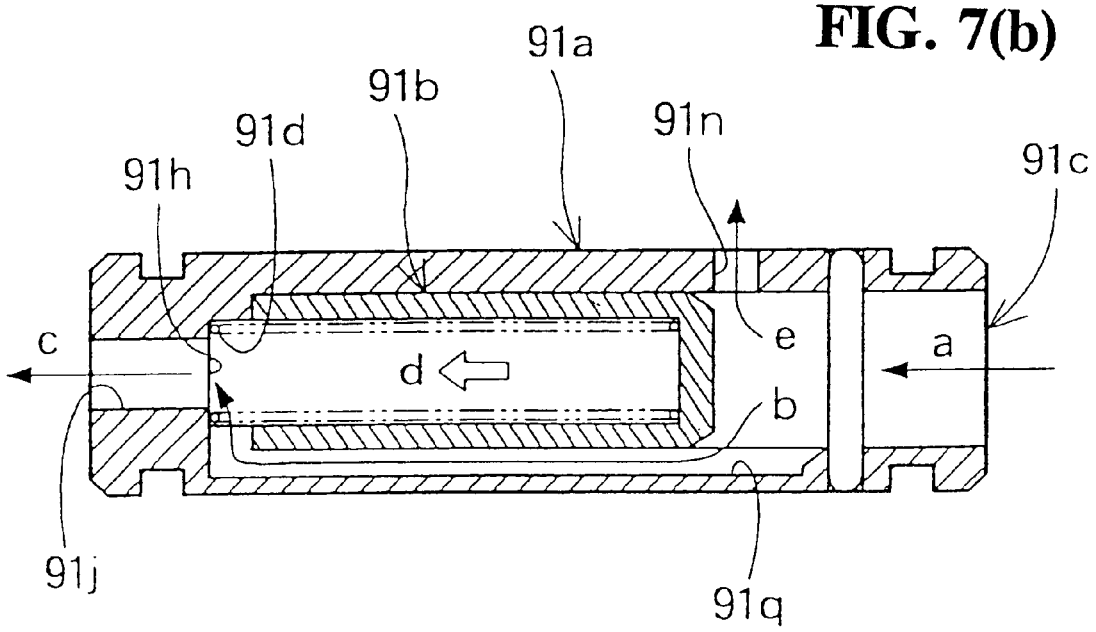

FIGS. 7(*a*) and 7(*b*) are sectional views of another embodiment of the relief valve constituting the lubricating structure of the present invention, wherein FIG. 7(*a*) illustrates components of the relief valve and FIG. 7(*b*) illustrates the function of the relief valve.

Referring to FIG. 7(*a*), a relief valve 91 includes a valve case 91*a* formed into a cylindrical shape with its bottom closed; a valve body 91*b* formed into a cylindrical shape with its bottom closed, which valve body is movably inserted in the valve case 91*a;* a coil spring 91*d* for elastically biasing the valve body 91*b* to an opening 91*c* side of the valve case 91*a;* and a pin 91*e* which passes through the valve case 91*a* for preventing the valve body 91*b* from being accidentally removed from the opening 91*c*.

Two O-ring grooves 91*g,* in which O-rings are to be fitted, are formed in an outer peripheral surface 91*k* of the valve case 91*a.* A bottom passage 91*j* as the passage for supplying oil from one oil supply passage to another oil supply passage is opened in a bottom 91*h* of the valve case 91*a.* A relief passage 91*n* and two pin insertion holes 91*p* are formed in the outer peripheral surface 91*k* in such a manner as to reach an inner peripheral surface 91*m.* A longitudinal groove 91*q* functioning as a throttle structure allowing the flow of oil between both oil chambers of the valve body 91*b* is axially formed in the inner peripheral surface 91*m.*

Referring to FIG. 7(*b*), when oil is supplied from the opening 91*c* side into the valve case 91*a* as shown by an arrow "a", it flows in the oil chamber on the bottom 91*n* side in the valve case 91*a* through the longitudinal groove 91*q* as shown by an arrow "b", and flows out of the valve case 91*a* through the bottom passage 91*j* as shown by an arrow "c".

At this time, the valve body 91*b* is moved in the direction shown by an arrow "d" against the elastic force of the coil spring 91*d.*

As a result, the relief passage 91*n* is opened, so that the oil flows out of the valve case 91 a as shown by an arrow "e".

As shown in FIGS. 2 and 6, according to the present invention, there is provided the lubricating structure for an internal combustion engine including the oil supply passage through which oil is supplied from the oil pumps 24 and 25 to portions to be lubricated, and the relief valve 54 which is opened for relieving part of the oil into the relief passages 54*n* (see FIG. 3(*a*)) when the pressure in the oil supply passage exceeds a specific value, or the relief valve 91 which is opened for relieving part of the oil into the relief passage 91*n* (see FIG. 7(*a*)) when the pressure in the oil supply passage exceeds a specific value, characterized in that the relief valve 54 or the relief valve 91 is interposed in the oil supply passage, and internally includes the bottom passage 54*j* (see FIG. 3(*a*)) or the bottom passage 91*j* (see FIG. 7(*a*)) for supplying oil from one case side cover 53 side to another second main bearing portion 2*b* side.

With this configuration, since any branched oil passage for the relief valve 54 or 91 is not required to be provided, it is possible to reduce the number of machining steps and lower the machining cost.

Further, since a space for disposing a branched oil passage is not required and the increase in space for disposing the relief valve 54 or 91 can be reduced, the engine 1 can be miniaturized.

The lubricating structure of the present invention is also characterized in that as shown in FIGS. 3(*a*) and 3(*b*), the orifice hole 54*q* functioning as the throttle structure for restricting the flow rate of oil to be supplied to portions to be lubricated by the relief valve 54 is provided in the oil supply passage, or as shown in FIGS. 7(*a*) and 7(*b*), the longitudinal groove 91*q* functioning as the throttle structure for restricting the flow rate of oil to be supplied to portions to be lubricated by the relief valve 91 is provided in the oil supply passage.

With this configuration, the amount of oil to be supplied to portions to be lubricated can be easily changed only by changing the throttle structure.

The direct supply of oil to portions to be lubricated is exemplified by the supply of oil by means of an oil supply member which is configured as the oil jet nozzle 11 in this embodiment. For example, oil is supplied to the oil jet nozzle 11 via the relief valve 54 and is supplied from the oil jet nozzle II into the inside of the piston 12. On the contrary, the indirect supply of oil to portions to be lubricated is exemplified by the supply of oil through scattering. For example, the oil, which has been relieved in the relief passages 54*n* of the relief valve 54 (see FIG. 3(*a*)) or in the relief passage 91*n* of the relief valve 91 (see FIG. 7(*a*)), is scattered in the crank chamber 2CR, to be supplied to the meshing portion of the main shaft drive gear 34, and the meshing portion between the cam shaft drive gear 33 and the cam chain 32 near the relief passages 54*n* or relief passage 91.

The lubricating structure of the present invention is also characterized in that the relief valve 54 or 91 is provided in the oil supply passage which passes through a portion near the cam chain 32 as the power transmission member in the engine 1.

With this configuration, the power transmission member can be lubricated with the oil which has flowed out of the relief passages 54*n* of the relief valve 54 or the relief passage 91 n of the relief valve 91. This means that it is not required to form any special oil passage for supplying oil to the power transmission member.

The lubricating structure for an internal combustion engine of the present invention is also characterized in that the power transmission member is configured as the cam chain 32 hung between the crank shaft 4 and the cam shaft in the engine 1, and the relief valve 54 or the relief valve 91 is provided in such a manner so as to cross the cam chain chamber 32*a* for containing the cam chain 32.

As a result, the cam chain 32 can be lubricated with the oil which has flowed out of the relief passage 54*n* or the relief passage 91n of the relief valve 54 or the relief valve 91. Further, since the oil adhering on the cam chain 32 can be scattered to the cylinder head, it is possible to lubricate respective portions of the cylinder head with the scattered oil.

Further, since the relief valve 54 or the relief valve 91 serves as a pipe member crossing the cam chain chamber 32*a,* it is possible to reduce the number of parts as compared with the case in which the relief valve 54 or 91 and the pipe member are provided separately from each other, and hence to reduce the manufacturing cost of the engine.

According to the lubricating structure for an internal combustion engine according to the present invention, since the relief valve is interposed in the oil supply passage, and the relief valve internally includes a passage for supplying oil from one oil supply passage to another oil supply passage, it is possible to eliminate the need of the provision of any branched oil passage for the relief valve and hence to reduce the number of machining steps and lower the machining cost.

Further, since a space for disposing a branched oil passage is not required and the increase in space for disposing the relief valve can be reduced, the engine can be miniaturized.

According to the lubricating structure for an internal combustion engine according to the present invention, since the throttle structure for restricting the flow rate of oil to be supplied to portions to be lubricated by the relief valve is provided in the oil supply passage, the amount of oil to be supplied to the portions to be lubricated can be easily changed only by changing the throttle structure.

According to the lubricating structure for an internal combustion engine according to the present invention, since the throttle structure is configured as an orifice hole opened in a valve body of the relief valve, the valve body of the relief valve can serve as the throttle structure. As a result, the lubricating structure can be simplified and the number of parts can be reduced, as compared with the case in which the valve body and a member in which the orifice hole is opened are provided separately from each other.

Accordingly, the manufacturing cost of the internal combustion engine can be reduced.

Further, the amount of oil to be supplied to the portions to be lubricated can be easily changed by replacing an existing valve body with a new valve body having an orifice whose cross-section is suitably changed from that of the orifice of the existing valve body.

According to the lubricating structure for an internal combustion engine according to the present invention, since the relief valve is provided in the oil supply passage passing through a portion near the power transmission member in the internal combustion engine, it is possible to lubricate the power transmission member with the oil which has flowed out of the relief passage of the relief valve, and hence to eliminate the need of providing any special oil passage for supplying oil to the power transmission member.

As a result, it is possible to reduce the manufacturing cost of the internal combustion engine.

According to the lubricating structure for an internal combustion engine according to the present invention, since the power transmission member is configured as a cam chain hung between a crank shaft and a cam shaft in the internal combustion engine and the relief valve is provided in such a manner as to cross the cam chain chamber for containing the cam chain, the cam chain can be lubricated with the oil which has flowed out of the relief passage of the relief valve. Further, since the oil adhering on the cam chain can be scattered to a cylinder head, it is possible to lubricate respective portions of the cylinder head with the scattered oil.

Further, since the relief valve serves as a pipe member crossing the cam chain chamber, it is possible to reduce the number of parts as compared with the case in which the relief valve and the pipe member are provided separately from each other, and hence to reduce the manufacturing cost of the engine.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lubricating structure for an internal combustion engine including an oil supply passage for supplying oil from an oil pump to portions to be lubricated and a relief valve which is opened for relieving part of the oil into a relief passage when the pressure in said oil supply passage exceeds a specific value comprising:

said relief valve is interposed in said oil supply passage, and said relief valve internally includes a passage for supplying oil from one oil supply passage to another oil supply passage;

said relief valve being provided in an oil supply passage passing through a portion near a power transmission member in said internal combustion engine;

said power transmission member being a cam chain hung between a crank shaft and a cam shaft in said internal combustion engine, and said relief valve is mounted to cross a cam chain chamber for containing said cam chain;

said relief passage being directed in a direction of the cam chain, a cam shaft drive gear or a main shaft drive gear.

2. The lubricating structure for an internal combustion engine according to claim 1, wherein a throttle structure for restricting the flow rate of the oil to be supplied to said portions to be lubricated by said relief valve is provided in said oil supply passage.

3. The lubricating structure for an internal combustion engine according to claim 2, wherein said throttle structure is configured as an orifice hole opened in a valve body of said relief valve.

4. A lubricating structure for an internal combustion engine comprising:

an oil supply passage for supplying oil from an oil pump to portions to be lubricated;

a relief valve being selectively opened for relieving part of the oil into a relief passage when the pressure in said oil supply passage exceeds a specific value;

said relief valve being interposed in said oil supply passage; and a passage for supplying oil from one oil supply passage to another oil supply passage, said passage being provided in said relief valve;

said relief valve being provided in an oil supply passage passing through a portion near a power transmission member in said internal combustion engine;

said power transmission member is a cam chain hung between a crank shaft and a cam shaft in said internal combustion engine, and said relief valve is mounted to cross a cam chain chamber for containing said cam chain;

said relief passage being directed in a direction of the cam chain, a cam shaft drive gear or a main shaft drive gear.

5. The lubricating structure for an internal combustion engine according to claim 4, wherein a throttle structure for restricting the flow rate of the oil to be supplied to said portions to be lubricated by said relief valve is provided in said oil supply passage.

6. The lubricating structure for an internal combustion engine according to claim 5, wherein said throttle structure is configured as an orifice hole opened in a valve body of said relief valve.

* * * * *